US006413047B1

(12) United States Patent
Green

(10) Patent No.: US 6,413,047 B1
(45) Date of Patent: Jul. 2, 2002

(54) FAN MOUNTABLE AIR FRESHENER DEVICE

(76) Inventor: Carl E. Green, 322 S. Hamilton, Lincoln, IL (US) 62656

( * ) Notice: Subject to any disclaimer, the term of this patent is extended or adjusted under 35 U.S.C. 154(b) by 0 days.

(21) Appl. No.: 09/770,259

(22) Filed: Jan. 26, 2001

(51) Int. Cl.[7] ..... F04D 29/00
(52) U.S. Cl. ..... 416/62; 416/146 R; 422/124
(58) Field of Search ..... 416/146 R, 62; 422/124, 5

(56) References Cited

U.S. PATENT DOCUMENTS

| | | | | |
|---|---|---|---|---|
| 4,664,847 | A | 5/1987 | Williams | |
| 4,944,898 | A | 7/1990 | Glaser | |
| D324,910 | S | 3/1992 | Portis | |
| 5,383,765 | A | 1/1995 | Baxter et al. | |
| 5,460,787 | A | * 10/1995 | Colon | 239/55 |
| 5,735,460 | A | * 4/1998 | Eisenbraun | 239/34 |
| 5,741,482 | A | 4/1998 | Modi | |
| 5,775,876 | A | 7/1998 | Walker et al. | |

* cited by examiner

*Primary Examiner*—F. Daniel Lopez
*Assistant Examiner*—Kimya N McCoy

(57) ABSTRACT

A fan mountable air freshener device for freshening the air in the surrounding enviroment. The fan mountable air freshener device includes an air freshener device that can be mounted to a blade of a ceiling fan, the air freshener includes a housing, which includes an upper wall and a lower wall. The lower wall is designed to be removably coupled to the blade of the ceiling fan. The housing includes a pair of side walls, a first end and second end, wherein the lower wall, the side walls and the upper wall are positioned such that the pair of side walls, the upper wall and the lower wall define a channel through the housing. The first end includes a first aperture for allowing air to travel into the channel. The second end of the housing includes a second aperture for allowing air to travel out of the channel. The housing is positioned such that the first end faces a leading edge of the blade of the ceiling fan whereby air is urged through the first aperture when the ceiling fan rotates. A scented material is disposed in the channel such that air passing through the channel passes over the scented material for dispersing the scent out of the channel.

14 Claims, 2 Drawing Sheets

FAN MOUNTABLE AIR FRESHENER DEVICE

BACKGROUND OF THE INVENTION

1. Field of the Invention

The present invention relates to air freshener devices and more particularly pertains to a new fan mountable air freshener device for freshening the air in the surrounding environment.

2. Description of the Prior Art

The use of air freshener devices is known in the prior art. More specifically, air freshener devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,775,876; U.S. Pat. No. 4,944,898; U.S. Pat. No. 4,664,847; U.S. Pat. No. 5,741,482; U.S. Pat. No. 5,383,765; and U.S. Pat. No. Des. 324,910.

While these devices fulfill their respective, particular objectives and requirements, the aforementioned patents do not disclose a new fan mountable air freshener device. The inventive device includes an air freshener device that can be mounted to a blade of a ceiling fan. The air freshener includes a housing, which includes an upper wall and a lower wall. The lower wall is designed to be removably coupled to the blade of the ceiling fan. The housing includes a pair of side walls, a first end and second. end, wherein the lower wall, the side walls and the upper wall are positioned such that the pair of side walls, the upper wall and the lower wall define a channel through the housing. The first end includes a first aperture for allowing air to travel into the channel. The second end of the housing includes a second aperture for allowing air to travel out of the channel. The housing is positioned such that the first end faces a leading edge of the blade of the ceiling fan whereby air is urged through the first aperture when the ceiling fan rotates. A scented material is disposed in the channel such that air passing through the channel passes over the scented material for dispersing the scent out of the channel.

In these respects, the fan mountable air freshener device according to the present invention substantially departs from the conventional concepts and designs of the prior art, and in so doing provides an apparatus primarily developed for the purpose of freshening the air in the surrounding environment.

SUMMARY OF THE INVENTION

In view of the foregoing disadvantages inherent in the known types of air freshener devices now present in the prior art, the present invention provides a new fan mountable air freshener device construction wherein the same can be utilized for freshening the air in the surrounding environment.

The general purpose of the present invention, which will be described subsequently in greater detail, is to provide a new fan mountable air freshener device apparatus and method which has many of the advantages of the air freshener devices mentioned heretofore and many novel features that result in a new fan mountable air freshener device which is not anticipated, rendered obvious, suggested, or even implied by any of the prior art air freshener devices, either alone or in any combination thereof.

To attain this, the present invention generally comprises an air freshener device that can be mounted to a blade of a ceiling fan; the air freshener includes a housing, which includes an upper wall and a lower wall. The lower wall is designed to be removably coupled to the blade of the ceiling fan. The housing includes a pair of side walls, a first end and second end, wherein the lower wall, the side walls and the upper wall are positioned such that the pair of side walls, the upper wall and the lower wall define a channel through the housing. The first end includes a first aperture for allowing air to travel into the channel. The second end of the housing includes a second aperture for allowing air to travel out of the channel. The housing is positioned such that the first end faces a leading edge of the blade of the ceiling fan whereby air is urged through the first aperture when the ceiling fan rotates. A scented material is disposed in the channel such that air passing through the channel passes over the scented material for dispersing the scent out of the channel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fan mountable air freshener device apparatus and method which has many of the advantages of the air freshener devices mentioned heretofore and many novel features that result in a new fan mountable air freshener device which is not anticipated, rendered obvious, suggested, or even implied by any of the prior art air freshener devices, either alone or in any combination thereof.

It is another object of the present invention to provide a new fan mountable air freshener device, which may be easily and efficiently manufactured and marketed.

It is a further object of the present invention to provide a new fan mountable air freshener device, which is of a durable and reliable construction.

An even further object of the present invention is to provide a new fan mountable air freshener device which is susceptible of a low cost of manufacture with regard to both materials and labor, and which accordingly is then susceptible of low prices of sale to the consuming public, thereby making such fan mountable air freshener device economically available to the buying public.

Still yet another object of the present invention is to provide a new fan mountable air freshener device which provides in the apparatuses and methods of the prior art some of the advantages thereof, while simultaneously overcoming some of the disadvantages normally associated therewith.

Still another object of the present invention is to provide a new fan mountable air freshener device for freshening the air in the surrounding environment.

Yet another object of the present invention is to provide an air freshener device that can be mounted to a blade of a ceiling fan and includes a housing having an upper wall and a lower wall. The lower wall is designed to be removably coupled to the blade of the ceiling fan. The housing includes a pair of side walls, a first end and second end, wherein the lower wall, the side walls and the upper wall are positioned such that the pair of side walls, the upper wall and the lower wall define a channel through the housing. The first end includes a first aperture for allowing air to travel into the channel. The second end of the housing includes a second aperture for allowing air to travel out of the channel. The housing is positioned such that the first end faces a leading edge of the blade of the ceiling fan whereby air is urged through the first aperture when the ceiling fan rotates. A scented material is disposed in the channel such that air passing through the channel passes over the scented material for dispersing the scent out of the channel.

Still yet another object of the present invention is to provide a new fan mountable air freshener device that provide a unique way to effortlessly freshen an entire room with the flip of a switch.

Even still another object of the present invention is to provide a new fan mountable air freshener device that are easy to install and eliminate the unsightly standard air freshener from being displayed throughout the environment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
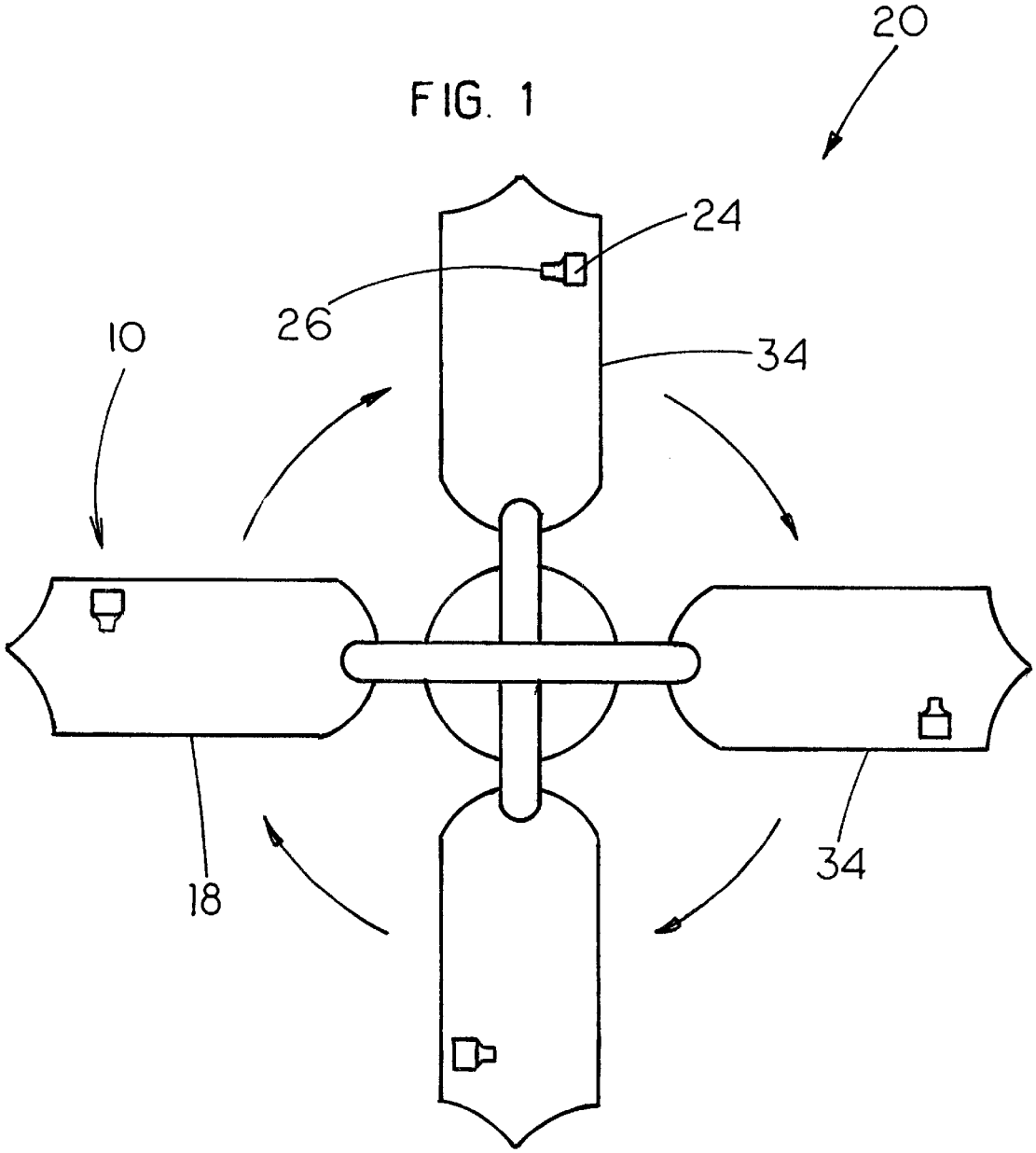
FIG. 1 is a top view of a new fan mountable air freshener device according to the present invention.
Figure 2:
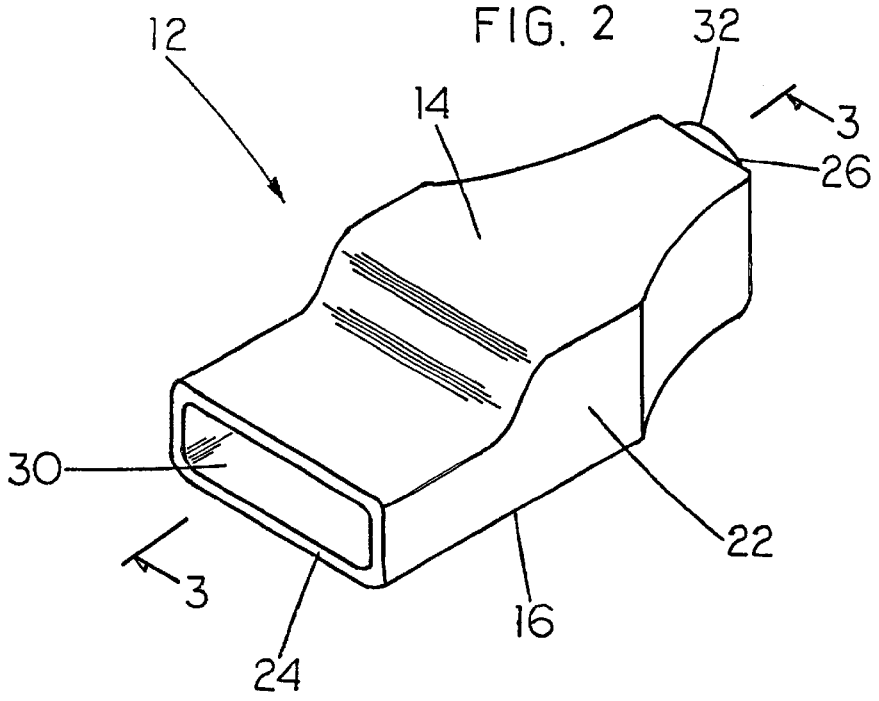
FIG. 2 is a perspective view of the present invention.
Figure 3:
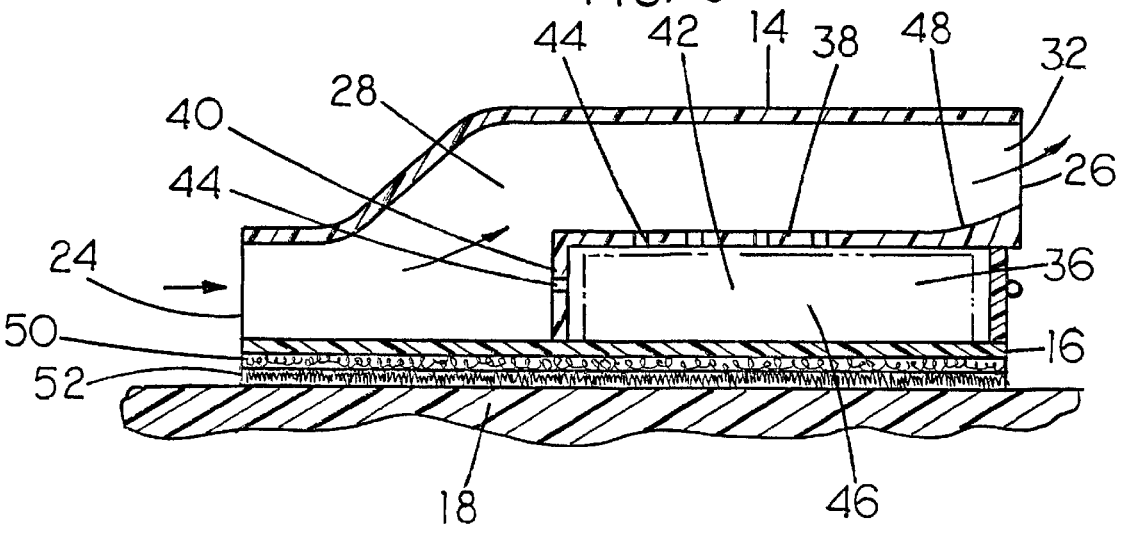
FIG. 3 is a cutaway view of the present invention.

With reference now to the drawings, and in particular to FIGS. 1 through 3 thereof, a new fan mountable air freshener device embodying the principles and concepts of the present invention and generally designated by the reference numeral 10 will be described.

As best illustrated in FIGS. 1 through 3, the fan mountable air freshener device 10 generally includes a housing 12 which includes an upper wall 14 and a lower wall 16. The lower wall 16 is designed for removably coupling to the blade 18 of the ceiling fan. The housing 12 includes a pair of side walls 22, a first end 24 and second end 26, wherein the lower wall 16, the side walls 22 and the upper wall 14 are positioned such that the pair of side walls 22, the upper wall 14 and the lower wall 16 define a channel 28 through the housing 12. The first end 24 includes a first aperture 30 for allowing air to travel into the channel 28, the second end 26 of the housing 12 includes a second aperture 32 for allowing air to travel out of the channel 28. The housing 12 is positioned such that the first end 24 faces a leading edge 34 of the blade 18 of the ceiling fan 20 whereby air is urged through the first aperture 30 when the ceiling fan 20 rotates.

A scented material 36 is disposed in the channel 28 such that air passes through the channel 28 over the scented material 36 to disperse the scent out of the channel 28.

A first interior wall 38 extends horizontally in the channel 28 between the pair of sidewalls 22. A second interior wall 40 extends vertically in between the lower wall 16, the first interior wall 38 and the pair of sidewalls 22. The first interior wall 38, the second interior wall 40 and the lower wall 16 defining a material holding space 42 for holding the scented material 36. The first interior wall 38 and the second interior wall 40 have a plurality of bores 44 therein for permitting air flowing through the channel 28 to pass through the material holding space 42 and over the scented material 36.

A closure portion 46 is removably insertable between the first interior wall 38 proximate the second end of the housing 26 and the lower wall 16 proximate the second end 26 of the housing 12 for retaining the scented material 36 in the material holding space 42 when the scented material 36 is positioned in the material holding space 42. The first aperture 30 of the first end 24 of the housing 12 has a cross-sectional area greater than a cross-sectional area of the second aperture 32 of the second end 26 of the housing 12 for increasing pressure of the air traveling through the channel 28. The second aperture 32 of the second end 26 of the housing 12 is positioned in a spaced relationship from the lower wall 16 of the housing 12 such that the first aperture 30 of the first end 24 of the housing 12 is aligned with an area between the second aperture 32 of the second end 26 of the housing 12 and the lower wall 16 of the housing 12.

An angled interior wall 48 in the channel 28 proximate the second aperture 32 of the second end 26 of the housing 12, the angled interior wall 48 is angled away from the lower wall 16 of the housing 12 and towards the second aperture 32 of the second end 26 of the housing 12 such that the angled interior wall 48 directs air passing through the channel 28 away from the lower wall 16 when air passes through the second aperture 32 of the second end 26 of the housing 12.

A first portion 50 of hook and loop fastener is coupled to an outer surface of the lower wall 16. A second portion 52 of hook and loop fastener is designed to be coupled to the blade 18 of the ceiling fan 20, the second portion 52 is complimentary to the first portion 50 whereby the first portion 50 is removably coupled to the second portion 52.

In use, a user would mount one air freshener device to each blade on a fan with a fastener. The user would then rotate the fan to allow air to flow through the chamber of the freshener device to freshen the room.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air freshener device for mounting to a blade of a ceiling fan, the air freshener comprising:

a housing having an upper wall and a lower wall, said lower wall being adapted for removably coupling to the blade of the ceiling fan;

said housing having a pair of side walls, a first end and second end, wherein said lower wall, said side walls and said upper wall are positioned such that said pair of side walls, said upper wall and said lower wall define a channel through said housing, said first end having a first aperture for allowing air to travel into said channel, said second end of said housing having a second aperture for allowing air to travel out of said channel, said housing being positioned such that said first end faces a leading edge of the blade of the ceiling fan whereby air is urged through said first aperture when the ceiling fan rotates;

a scented material being disposed in said channel such that air passing through said channel passes over said scented material for dispersing the scent out of said channel;

a first interior wall extending horizontally in said channel between said pair of side walls;

a second interior wall extending vertically in between said lower wall, said first interior wall and said pair of side walls; and said first interior wall, said second interior wall and said lower wall defining a material holding space for holding said scented material.

2. The air freshener device as set forth in claim 1, wherein said first interior wall and said second interior wall have a plurality of bores therein for permitting air flowing through said channel to pass through said material holding space and over said scented material.

3. The air freshener device as set forth in claim 2, further comprising a closure portion being removably insertable between said first interior wall proximate said second end of said housing and said lower wall proximate said second end of said housing for retaining said scented material in said material holding space when said scented material is positioned in said material holding space.

4. The air freshener device as set forth in claim 1, wherein said first aperture of said first end of said housing has a cross-sectional area greater than a cross-sectional area of said second aperture of said second end of said housing for increasing pressure of the air traveling through said channel.

5. The air freshener device as set forth in claim 1, wherein said second aperture of said second end of said housing is positioned in a spaced relationship from said lower wall of said housing such that said first aperture of said first end of said housing is aligned with an area between said second aperture of said second end of said housing and said lower wall of said housing.

6. The air freshener device as set forth in claim 1, further comprising an angled interior wall in said channel proximate said second aperture of said second end of said housing, said angled interior wall being angled away from said lower wall of said housing and towards said second aperture of said second end of said housing such that said angled interior wall directs are passing through said channel away from said lower wall when air passes through said second aperture of said second end of said housing.

7. The air freshener device as set forth in claim 1, further comprising a first portion of hook and loop fastener coupled to an outer surface of said lower wall;

a second portion of hook and loop fastener adapted for coupling to the blade of the ceiling fan, said second portion being complimentary to said first portion whereby said first portion is removably couplable to said second portion.

8. The air freshener device as set forth in claim 1, further comprising:

wherein said first interior wall and said second interior wall have a plurality of bores therein for permitting air flowing through said channel to pass through said material holding space and over said scented material;

a closure portion being removably insertable between said first interior wall proximate said second end of said housing and said lower wall proximate said second end of said housing for retaining said scented material in said material holding space when said scented material is positioned in said material holding space;

wherein said first aperture of said first end of said housing has a cross-sectional area greater than a cross-sectional area of said second aperture of said second end of said housing for increasing pressure of the air traveling through said channel;

wherein said second aperture of said second end of said housing is positioned in a spaced relationship from said lower wall of said housing such that said first aperture of said first end of said housing is aligned with an area between said second aperture of said second end of said housing and said lower wall of said housing;

an angled interior wall in said channel proximate said second aperture of said second end of said housing, said angled interior wall being angled away from said lower wall of said housing and towards said second aperture of said second end of said housing such that said angled interior wall directs are passing through said channel away from said lower wall when air passes through said second aperture of said second end of said housing;

a first portion of hook and loop fastener coupled to an outer surface of said lower wall; and a second portion of hook and loop fastener adapted for coupling to the blade of the ceiling fan, said second portion being complimentary to said first portion whereby said first portion is removably couplable to said second portion.

9. An air freshener device for mounting to a blade of a ceiling fan, the air freshener comprising:

a housing having an upper wall and a lower wall, said lower wall being adapted for removably coupling to the blade of the ceiling fan;

said housing having a pair of side walls, a first end and second end, wherein said lower wall, said side walls and said upper wall are positioned such that said pair of side walls, said upper wall and said lower wall define a channel through said housing, said first end having a first aperture for allowing air to travel into said channel, said second end of said housing having a second aperture for allowing air to travel out of said channel, said housing being positioned such that said first end faces a leading edge of the blade of the ceiling fan whereby air is urged through said first aperture when the ceiling fan rotates;

a scented material being disposed in said channel such that air passing through said channel passes over said scented material for dispersing the scent out of said channel; and said first aperture of said first end of said housing having a cross-sectional area greater than a cross-sectional area of said second aperture of said second end of said housing for increasing pressure of the air traveling through said channel.

10. The air freshener device as set forth in claim 9, wherein said second aperture of said second end of said housing is positioned in a spaced relationship from said lower wall of said housing such that said first aperture of said first end of said housing is aligned with an area between said second aperture of said second end of said housing and said lower wall of said housing.

11. The air freshener device as set forth in claim 9, further comprising an angled interior wall in said channel proximate said second aperture of said second end of said housing, said angled interior wall being angled away from said lower wall of said housing and towards said second aperture of said second end of said housing such that said angled interior wall directs are passing through said channel away from said lower wall when air passes through said second aperture of said second end of said housing.

12. The air freshener device as set forth in claim 9, further comprising a first portion of hook and loop fastener coupled to an outer surface of said lower wall;

a second portion of hook and loop fastener adapted for coupling to the blade of the ceiling fan, said second portion being complimentary to said first portion whereby said first portion is removably couplable to said second portion.

13. An air freshener device for mounting to a blade of a ceiling fan, the air freshener comprising:

a housing having an upper wall and a lower wall, said lower wall being adapted for removably coupling to the blade of the ceiling fan;

said housing having a pair of side walls, a first end and second end, wherein said lower wall, said side walls and said upper wall are positioned such that said pair of side walls, said upper wall and said lower wall define a channel through said housing, said first end having a first aperture for allowing air to travel into said channel, said second end of said housing having a second aperture for allowing air to travel out of said channel, said housing being positioned such that said first end faces a leading edge of the blade of the ceiling fan whereby air is urged through said first aperture when the ceiling fan rotates;

a scented material being disposed in said channel such that air passing through said channel passes over said scented material for dispersing the scent out of said channel; and an angled interior wall in said channel proximate said second aperture of said second end of said housing, said angled interior wall being angled away from said lower wall of said housing and towards said second aperture of said second end of said housing such that said angled interior wall directs are passing through said channel away from said lower wall when air passes through said second aperture of said second end of said housing.

14. The air freshener device as set forth in claim 13, further comprising a first portion of hook and loop fastener coupled to an outer surface of said lower wall;

a second portion of hook and loop fastener adapted for coupling to the blade of the ceiling fan, said second portion being complimentary to said first portion whereby said first portion is removably couplable to said second portion.

* * * * *